US005870810A

United States Patent [19]

Harrison et al.

[11] Patent Number: 5,870,810

[45] Date of Patent: Feb. 16, 1999

[54] SEAT BELT BUCKLE

[75] Inventors: Mark John Harrison, Belfast; Michael John Jackson, Cullybackey, both of United Kingdom

[73] Assignee: European Components Co., Limited, Belfast, United Kingdom

[21] Appl. No.: 946,308

[22] Filed: Oct. 7, 1997

[30] Foreign Application Priority Data

Oct. 7, 1996 [GB] United Kingdom ..... 9620900

[51] Int. Cl.[6] ..... A44B 11/26

[52] U.S. Cl. ..... 24/641

[58] Field of Search ..... 24/633, 641, 637, 24/645, 636, 638

[56] References Cited

U.S. PATENT DOCUMENTS

| | | | |
|---|---|---|---|
| 4,451,958 | 6/1984 | Robben et al. | 24/641 X |
| 4,899,424 | 2/1990 | Barnes et al. | 24/641 |
| 4,928,366 | 5/1990 | Ballet | 24/641 |
| 5,210,915 | 5/1993 | Clarke | 24/641 |
| 5,271,129 | 12/1993 | Clarke et al. | 24/641 |

FOREIGN PATENT DOCUMENTS

| | | |
|---|---|---|
| 2 218 457 | 11/1989 | United Kingdom . |
| 2 218 458 | 11/1989 | United Kingdom . |
| 2 238 074 | 5/1991 | United Kingdom . |

*Primary Examiner*—James R. Brittain
*Attorney, Agent, or Firm*—Foley & Lardner

[57] ABSTRACT

A seat belt buckle which is adapted to releasably engage a latch plate 42 having an aperture 40 therein. The buckle comprises a rigid frame 10 including a base 12 and upstanding side walls 14 adapted to guide the latch plate 42 longitudinally of the frame 10. A locking member 24 is mounted on the frame and carries a downwardly projecting locking element 38. The locking member 24 is pivotable between a lower latched position in which the locking element 38 engages the aperture 40 in the latch plate 42 to retain the latch plate in place, and an upper unlatched position. A pair of wings 30 extend laterally from the locking member 24 and engage in the side walls 14 to pivotally and resiliently mount the locking member 24 for movement between its upper and lower positions. The wings 30 are capable of elastic flexing upon axial loading of the locking member 24 by the latch plate 40. At least one stop member 34 extends laterally from the locking member 24 and engages abutments on the rigid frame 10, at least when the locking member 24 is in its lower position, to prevent flexing of the wings 30 beyond their elastic limit and the at least one stop member 34 is joined to an adjacent one of the wings 30 outside the side walls 14 of the frame 10.

10 Claims, 2 Drawing Sheets

SEAT BELT BUCKLE

The present invention relates to seat belt buckles for seat belts in motor vehicles. One form of such seat belt buckle involves a latch plate having an aperture therein, engageable on one part of the seat belt, and a buckle having a rigid frame including a base having an opening therein and upstanding side walls adapted to guide the latch plate longitudinally of the frame.

The latch plate can be inserted against the action of a spring loaded ejector and when in the fully inserted position a locking member is pivoted to a lower latching position in which a locking element engages in the aperture in the latch plate. A push button is used to release the locking member which pivots back to an unlatched position.

EP-0452464 discloses a seat belt buckle adapted to releasably engage a latch plate having an aperture therein, said buckle comprising a rigid frame including a base, upstanding side walls adapted to guide the latch plate longitudinally of the frame, a locking member pivotally mounted on the frame and pivotal between a lower latched position and an upper unlatched position, said locking member carrying a downwardly projecting locking element engageable in said aperture in the latch plate to retain the latch plate in place, a pair of wings extending laterally from said locking member and engaging in said side walls to pivotally and resiliently mount the locking member for movement between its upper and lower positions, said wings being capable of elastic flexing, upon axial loading of said locking member by said latch plate, and at least one stop member extending laterally from said locking member, said at least one stop member engaging abutments on said rigid frame to prevent flexing of said wings beyond their elastic limit.

It is important that such seat belt buckles should have an easy and effective latching of the latch plate and should easily release the latch plate by operation of a release mechanism e.g. by means of a push button. It is most important to retain the latch plate in a latched position in the buckle even when the latch plate and buckle are subject to a very heavy impact load, and also that the latch plate should be reliably releasable from the buckle after application of a high load.

Accordingly, in the present invention, the at least one stop member is joined to an adjacent one of said wings outside the side walls of the frame.

The provision of the stop member or members prevents excessive flexing of the wings, which act as the pivot for the locking member, so that the wings never are distorted beyond their elastic limit.

More importantly, joining the wings and stop member or members outside the frame increases the ultimate strength of the stop member or members since it/they are not simply cantilevered from the locking member but is/are supported on either side of the abutments, changing the loading distribution. The flexing of the wings is not detrimentally affected by linking them to the stop member.

The stop member may take a number of forms but advantageously each stop member extends laterally from the locking member forwardly from the wings and may comprise a pair of arms engaging, at least in the lower latching position of the locking member, against abutments in the side walls. The arms are preferably joined to the ends of respective wings outside the walls of the frame by integral curved arches. In a presently preferred construction, said at least one stop member, said adjacent wing and the body of the locking member define an aperture, the portion of which aperture between said side walls having a semi-elliptical shape. In a simple construction the abutments are in the form of open-topped notches in the upper edges of the side walls into which the arms move in the lower latched position.

Preferably said base has an opening therein into which the locking element passes when the locking member is in the lower latched position.

Preferably the locking element in the lower latching position of the locking member, has its forward edge spaced from the forward edge of said opening by a given distance under normal conditions. Desirably said at least one stop member has its forward edge spaced from its associated abutment by a spacing less than said given distance, whereby the load bearing capacity of the or each stop member and its associated abutment are enhanced by engagement of the forward edge of the locking element with the rearward edge of the opening.

Preferably the seat belt buckle further comprises a bar extending transversely of the frame between said side walls, said bar being spaced above the base, a slider slidable longitudinally of the locking member between a first position in which it is located under said bar, in the lower latched position and a second position in which it allows said locking member to pivot to its upper unlatched position, a slider spring to urge the slider towards its first position, and a push button provided to push the slider to its first position, wherein said slider is resiliently engaged by said slider spring against the rear of said bar to retain the locking member in its upper unlatched position. The provision of the bar extending over the slider assists in the withstanding of heavy loads and prevents inadvertent release of the buckle.

Advantageously the rearward edge of said bar and the forward edge of said slider are co-operatingly chamfered to retain the locking member in its upper unlatched position when said forward and rearward edges are inter-engaged by said slider spring.

In order that the present invention may more readily by understood, the following description is given, merely by way of example, reference being made to the accompanying drawings in which.

Figure 1:
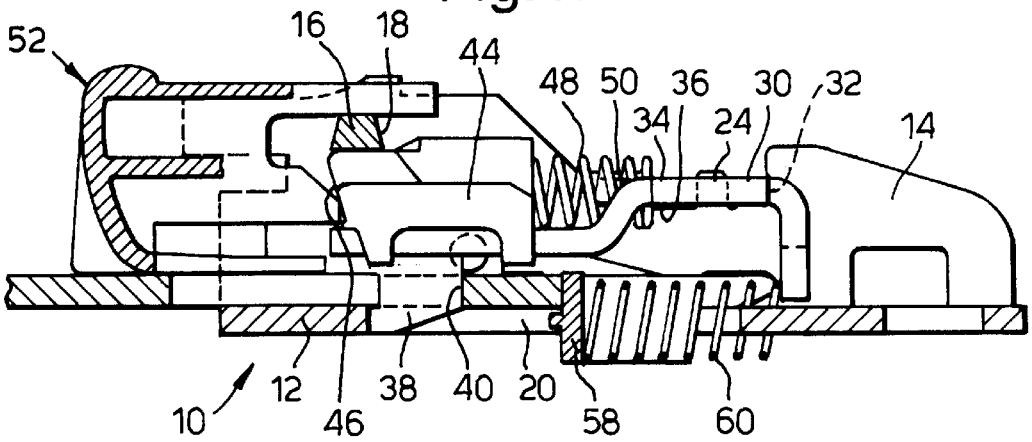
FIG. 1 is a side elevation of one embodiment of buckle according to the invention shown in the latched position.
Figure 2:
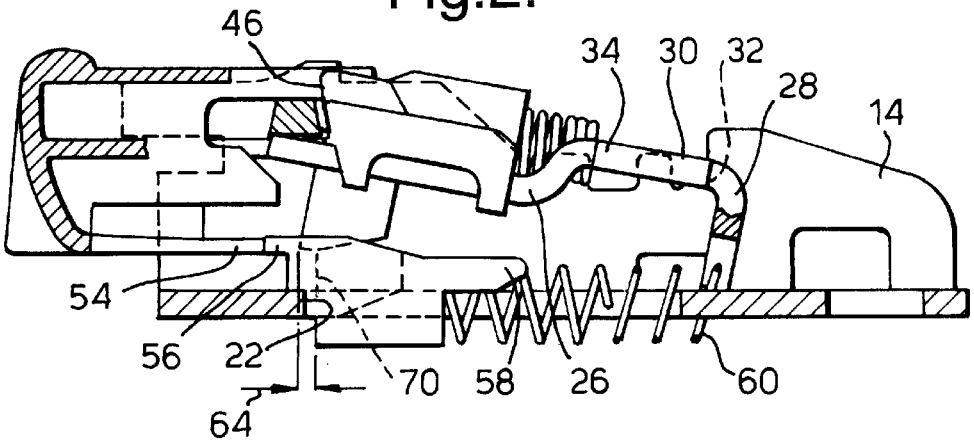
FIG. 2 is a similar view in section in the unlatched position.

Referring first to FIG. 1 the buckle includes a rigid frame 10 having a base plate 12 having two upstanding side walls 14 extending from each side edge thereof. A bar 16 extends between the side walls 14 and is spaced from and parallel to the base plate 12. An opening 20 is formed in the base plate 12 and is provided with a front edge 22 (FIG. 2).

Pivotally mounted between the side walls 14 is a locking member 24, which includes a forwardly extending body 26 and downwardly extending legs 28. The body is provided with two laterally extending wings 30 engaging in rear notches 32 in the side walls 14. Extending parallel to these wings 30 are arms 34 which can, in the lower latched position as illustrated in FIG. 1, engage in forward notches 36 in the side wall. The ends of the wings 30 and arms 34 on respective sides of the buckle are joined together outside the frame as well as being connected to the locking member 24 between the walls 14 of the frame 10. Adjacent wings and arms are linked by integral curved arches 37.

At the forward end of the body 26 of the locking member is a locking element 38 which, in the latched position, passes through an aperture 40 in a latch plate 42 to retain the latch plate in place. It will be noted that longitudinally slidable on the locking member 24 is a slider 44 having a chamfered leading edge 46. The slider is urged towards the front (the left in the Figures) by a slider spring 48 engaged over a projection 50 on the body 26 of the locking member 24.

Longitudinally slidable on the side walls 14 is a push button 52 which has rearward projections 54 engaging forward projections 56 on an ejector 58 longitudinally slidable in the opening 20 in the base plate 12, and urged to the forward position by an ejector spring 60.

In use, starting from the position illustrated in FIG. 2, a latch plate 42 is inserted in the guide channel formed by the base plate 12 and the side walls 14, it causes the ejector 58 to move rearwardly, that is to the right, against the action of its spring 60. This movement continues until the ejector is moved so far rearwards that it engages on the bottom of the leg 28 of the locking member 24. The resulting couple rotates the locking member/slider system causing the slider 44 to move down and return under the bar 16 to the position illustrated in FIG. 1. When the plate 42 is unloaded, the aperture 40 therein abuts the locking element 38 which retains the latch plate 42 in place so that the buckle cannot unlatch.

In this condition, if an accident or the like occurs, and a very great strain is put on the buckle, then the latch plate 42 will be urged forward and will move with it the locking element 38, thereby closing the gap 64 illustrated in FIG. 2, so that the front face of the locking element 38 approaches and may abut the front face 22 of the aperture 20. During this movement, the wings 30 will flex rearwards but the arms 34 engaging the front of the notches 36 will prevent anything more than a limited flexing so that the wings are not stressed beyond their elastic limit. The strength of the arms 34 is increased by being joined to the wings 30 outside the frame 10, and the integral arches 37 connecting the arms and wings are curved to ensure that the load is distributed and that stresses in that component are not too localised.

Figure 3:
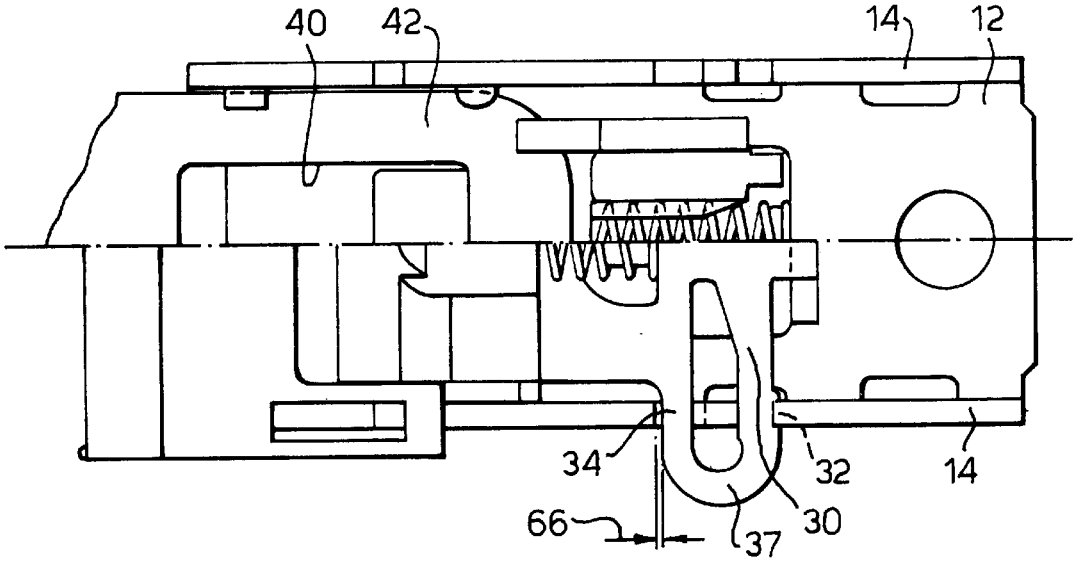
FIG. 3 is a plan view, half in section, of the buckle illustrated in FIGS. 1 and 2.

With the reduction of load (after impact) both the wings and the main body of the locking member recover elastically to restore the clearances (FIG. 3) between the locking member 34 and the frame sufficient to allow the front face of the locking element to sweep past the frame edge when the locking member is released to the unlatched position and in particular with the release performed whilst specific test loads are being applied longitudinally through the latch plate.

Figure 4:
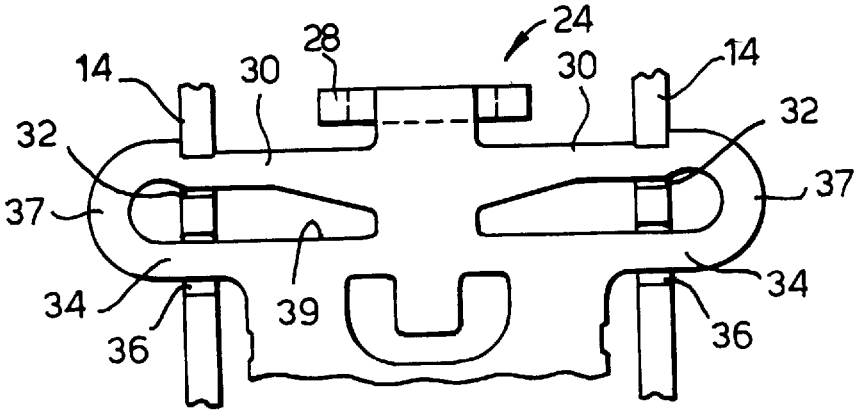
FIGS. 4 and 5 illustrate portions of locking members according to two embodiments of the buckle according to the invention.
Figure 5:
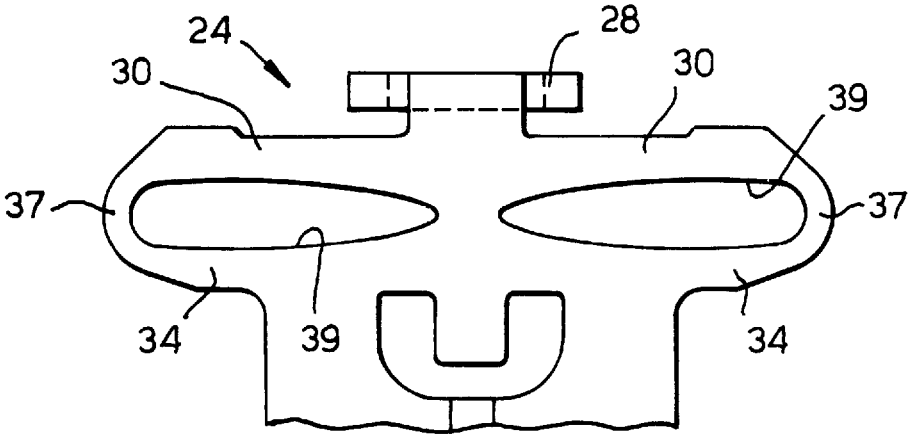

FIGS. 4 and 5 show portions of locking member according to two embodiments of the invention. In FIG. 4, the wings 30 and arms 34 are shown located in notches 32 and 36 respectively in the side walls of the frame. The wings, arms and integral arches define an opening 39. The presently preferred embodiment is shown in FIG. 5 in which the wings and arms meet the body of the locking member between the side walls so that the opening 39 has a semi-elliptical profile. This improves their elasticity and flexibility. It also distributes any stresses where the wings and arms join the body of the locking member to increase its strength.

We claim:

1. A seat belt buckle adapted to releasably engage a latch plate having an aperture therein, said buckle comprising a rigid frame including a base and upstanding side walls adapted to guide the latch plate longitudinally of the frame; a locking member pivotally mounted on the frame and pivotal between a lower latched position and an upper unlatched position; a downwardly projecting locking element carried by said locking member, said locking element being engageable in said aperture in the latch plate effective to retain the latch plate in place; a pair of wings extending laterally from said locking member and engaging in said side walls effective to pivotally and resiliently mount the locking member for movement between its upper and lower positions, wherein said wings are capable of elastic flexing, upon axial loading of said locking member by said latch plate; at least one stop member extending laterally from said locking member, said at least one stop member engaging abutments on said rigid frame at least when the locking member is in its lower latched position, to prevent flexing of said wings beyond their elastic limit, and means joining said at least one stop member to an adjacent one of said wings at a location outside said side walls of the frame.

2. A seat belt buckle according to claim 1, wherein said means joining said at least one stop member and said adjacent wings are formed by an integral curved arch outside said frame.

3. A seat belt buckle according to claim 2, wherein said at least one stop member, said adjacent wing and said integral curved arch define an opening, a portion of said opening between said side walls defining a semi-elliptical shape.

4. A seat belt buckle according to claim 1, wherein said at least one stop member extends laterally from said locking member forwardly of said wings.

5. A seat belt buckle according to claim 4, wherein said abutments are formed in said side walls and wherein said at least one stop member comprises a pair of arms engaging, at least in the lower position of the latching member, against said abutment.

6. A seat belt buckle according to claim 5, wherein said abutments are in a form of notches in the upper edges of said side walls.

7. A seat belt buckle according to claim 1, wherein said base comprises an opening therein into which the locking element passes when the locking member is in the lower latched position.

8. A seat belt buckle according to claim 7, wherein the locking element, in the lower latching position of the locking member, has its forward edge spaced from the rearward edge of said opening by a given distance under normal conditions.

9. A seat belt buckle according to claim 8, wherein at least one stop member has its forward edge spaced from its associated abutment by a spacing less than said given distance, whereby the load bearing capacity of the or each stop member and its associated abutment are enhanced by engaged of the forward edge of the locking element with the rearward edge of the opening.

10. A seat belt buckle according to claim 1, further comprising a bar extending transversely of the frame between said side walls, said bar being spaced above the base, a slider slidable longitudinally of the locking member between a first position in which it is located under said bar, in the lower latched position and a second position in which it allows said locking member to pivot to its upper unlatched position, a slider spring to urge the slider towards its first position, and a push button provided to push the slider to its first position, wherein said slider is resiliently engaged by said slider spring against the rear of said bar to retain the locking member in its upper unlatched position.

* * * * *